United States Patent [19]

Hotani

[11] Patent Number: 4,993,198

[45] Date of Patent: Feb. 19, 1991

[54] BRUSH ROLL FOR BRUSHING METAL PLATES

[75] Inventor: Setsuo Hotani, Wakayama, Japan

[73] Assignee: Hotani Co., Ltd., Japan

[21] Appl. No.: 257,226

[22] Filed: Oct. 13, 1988

[30] Foreign Application Priority Data

Oct. 14, 1987 [JP] Japan ..... 62-258549

[51] Int. Cl.[5] ..... B24B 9/02

[52] U.S. Cl. ..... 51/334; 51/337; 51/168

[58] Field of Search ..... 51/334, 337, 332, 331, 51/355, 376, 378, 390, 336, 358, 168; 15/159 R, 159 A, 179, 180, 183, 191 R, 191 A, 194, 200

[56] References Cited

U.S. PATENT DOCUMENTS 2,324,461 7/1943 Anderson et al. ..... 15/183
3,696,563 10/1972 Rands ..... 51/332
4,662,044 5/1987 Kayabara ..... 15/183
4,729,193 3/1988 Gant et al. ..... 51/168

*Primary Examiner*—Frederick R. Schmidt
*Assistant Examiner*—M. Rachuba
*Attorney, Agent, or Firm*—Larson and Taylor

[57] ABSTRACT

A brush roll comprising a multiplicity of brush disk segments mounted on a shaft in a circular arrangement around the axis of the shaft and arranged closely longitudinally of the shaft, each of the brush disk segments including a board substantially in the form of a sector with an angle of about 15 to about 60 degrees, and a plurality of abrasive members attached to and arranged along the outer peripheral edge of the board, the board having a key substantially in the form of a dovetail and opposed to the shaft, the shaft having a peripheral surface formed with substantial key grooves, the key grooves substantially resembling a dovetail and each extending longitudinally of the shaft for the key to fit in.

11 Claims, 6 Drawing Sheets

BRUSH ROLL FOR BRUSHING METAL PLATES

BACKGROUND OF THE INVENTION

1. Field of the Invention

The present invention relates to brush rolls for brushing metal plates, and more particularly to brush rolls for use in brushing, i.e. polishing, grinding, cleaning or otherwise treating steel plates or sheets, thin stainless steel sheets, other metal strips or the like in the cold rolling process.

2. Description of the Prior Art

Brush rolls which are well known for such a brushing treatment comprises a multiplicity of annular brush disks each in the form of a single piece and bristles of synthetic material attached to the outer peripheral edge of the disk. The brush disks are fitted to a shaft and drivingly connected to the shaft. Since the brush disk of the prior art is a completely annular piece, the disk can not be fitted to the shaft unless it is passed over the shaft end. For this fitting method, the shaft must be supported only at its one end with the other end thereof left unsupported as a free end. Accordingly, the shaft is usually positioned vertically when the brush disks are to be fitted thereto. The shaft of this type of brush roll is generally as long as about 3 m. Difficulties are encountered in fitting the disks from shaft free end with the long shaft positioned vertically. In fact, the worker must move up and down repeatedly on a lift when fitting the disks to the shaft. This work lacks safety.

The disk of the prior art is a thin metal plate so as to achieve the greatest possible cost reduction and assure ease of machining. Holes are formed in the thin disk at a spacing along its outer periphery, a bundle of bristles is passed through each hole and then bent outward in a U-shape, and the bristles are bound together at the bent portion. Accordingly, unless the multiplicity of brush disks fitted to the shaft are fully compressed by a press, the disks can not be assembled compactly as required longitudinally of the shaft. A large-sized press of great output is needed to effect the desired compression filfilling the requirement. Such a press is generally as great as about 4 m in height and about 50 to about 100 tons in output.

The assembly of disks is locked to the shaft by a snap ring and held compressed.

The brush roll usually has a length greater than the width of the metal plate to be brushed. Accordingly, the wear of the bristles is not uniform longitudinally of the brush roll. If the bristles are worn unevenly, the uneven wear must be remedied. For this purpose, it is practice with the prior art to trim the bristle assembly of the brush roll, or to replace the brush disks with worn bristles by new ones. In the former case, the bristles must be trimmed at a repair factory by a skilled worker. The replacement of brush disks involves the necessity of gradually releasing the brush disks from compression; if otherwise some disks will flounce to incur a hazard. Thus, neither of the prior-art methods are easy to practice at the site of brushing operation.

SUMMARY OF THE INVENTION

An object of the present invention is to provide a brush roll for brushing metal plates or sheets wherein the brush disks are mountable on the shaft from one side thereof without the necessity of placing the disks on the shaft from one end thereof. When the disks are mountable on the shaft from one side thereof, the disks can be installed in place easily with high safety, with the shaft positioned horizontally and supported at its oppsite ends by suitable supports which are readily available. Further in the case where the disks are to be mounted on the shaft as positioned vertically, the work can be performed more easily than conventionally. When to be mounted sidewise of the shaft, disks can be attached to the shaft over a shaft portion of relatively large length while the worker is staying at one location, so that the shift of work site needed is much less frequent than in the conventional practice. This assures a correspondinly simplified mode of control when industrial robots are used for automatically mounting the disks on the shaft.

Another object of the invention is to provide a brush roll wherein the substantial brush disks can be fastened together longitudinally of the shaft without using any press machine.

To fulfill the above and other objects, the present invention provides a brush roll which comprises a multiplicity of brush disk segments mounted on a shaft in a circular arrangement around the axis of the shaft and arranged closely longitudinally of the shaft. Each of the brush segments includes a board substantially in the form of a sector with an angle of about 15 to about 60 degrees, and a plurality of abrasive members attached to the outer peripheral edge of the board. The board has a key substantially in the form of a dovetail and opposed to the shaft. The shaft has a peripheral surface which is formed with substantial key grooves substantially resembling a dovetail and each extending longitudinally of the shaft for the key to fit in.

The term "abrasive member" as used herein and in the appended claims refers not only to a member for polishing metal strips or the like but also to a member which is usable for various brushing treatments including grinding, and cleaning.

The provision of the brush disk segments in the brush roll of the invention results in the following advantages.

The brush disk segment can be keyed to or attached to the shaft by orienting the segment in the specified direction to be described later, fitting the key of the segment into the key groove of the shaft from one side of the shaft and turning the segment through 90 degrees. When this procedure is repeated circumferentially of the shaft and longitudinally thereof, the brush disk segments can be arranged as stated above. The row of brush disk segments in a circular arrangement around the axis of the shaft substantially provides a brush disk.

Thus, the brush disk substantially serving as such can be mounted on the shaft from one side thereof, i.e. sidewise thereof, instead of placing the disk on the shaft from one end thereof. According to the present invention, therefore, the disks can be installed in place easily with high safety, with the shaft positioned horizontally and supported at its opposite ends by suitable supports which are readily available. Further when the disks are to be attached to the shaft as positioned vertically, the work can be performed more easily than conventionally.

With the present invention, the brush disk segments are each in the form of a board and can therefore be arranged closely on the shaft longitudinally thereof without the need to compress the arrangement of the disk segments. When the abrasive member has an outside diameter not larger than the thickness of the disk segment, the segments are arranged closely as stated above in contact with one another. When the outside diameter of the abrasive member is slightly greater than the segment thickness, a washer of suitable thickness is interpoosed between the disk segments arranged longitudinally of the shaft, whereby the same result as above can be achieved. Accordingly, there is no need to use a press for assembling the substantial brush disks longitudinally of the shaft as required. In fastening the disk segments together, the desired result can be obtained using simple fastening means such as bolts and nuts. Consequently, the disk segments in a brush roll portion where the abrasive members are worn can be easily removed from the shaft and replaced by new ones without any hazard at the site of brushing operation. When the abrasive members of some disk segments are to be trimmed, the work can be performed easily after removing these segments.

DETAILED DESCRIPTION OF THE PREFERRED EMBODIMENTS

Figure 1:
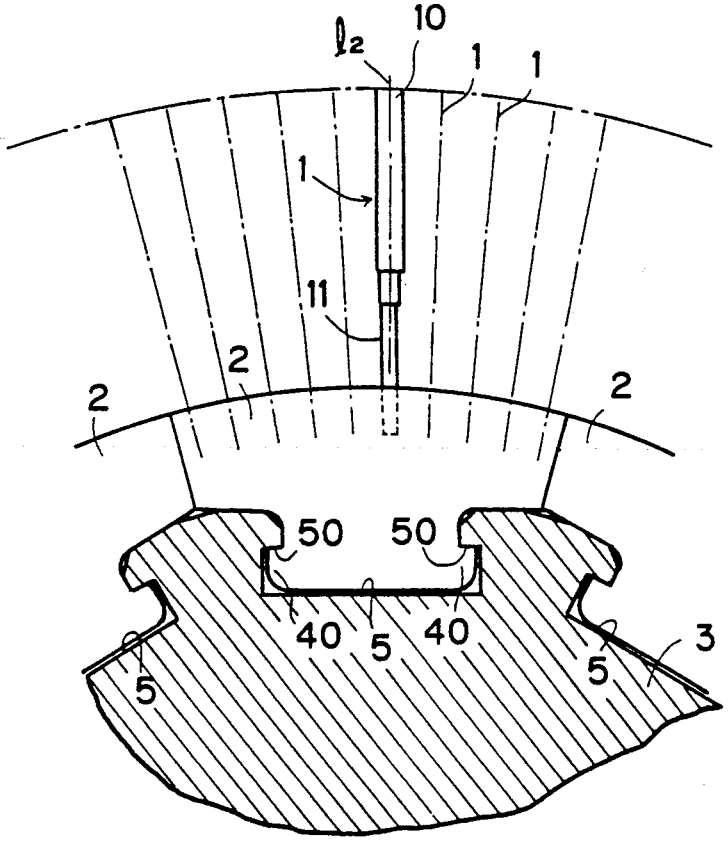
FIG. 1 is a fragmentary elevation showing a brush roll embodying the invention and also schematically showing a brush disk segment.
Figure 2:
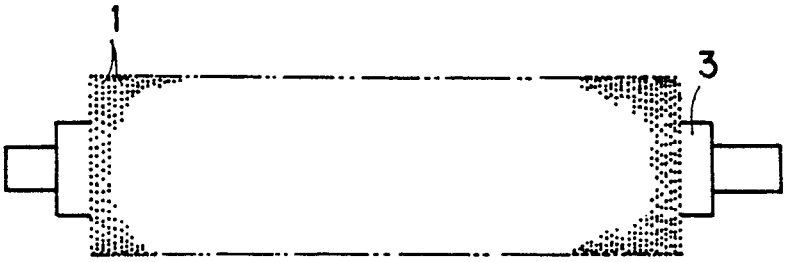
FIG. 2 is a front view showing the brush roll.

Throughout the drawings, like parts are designated by like reference numerals.

Figure 3:
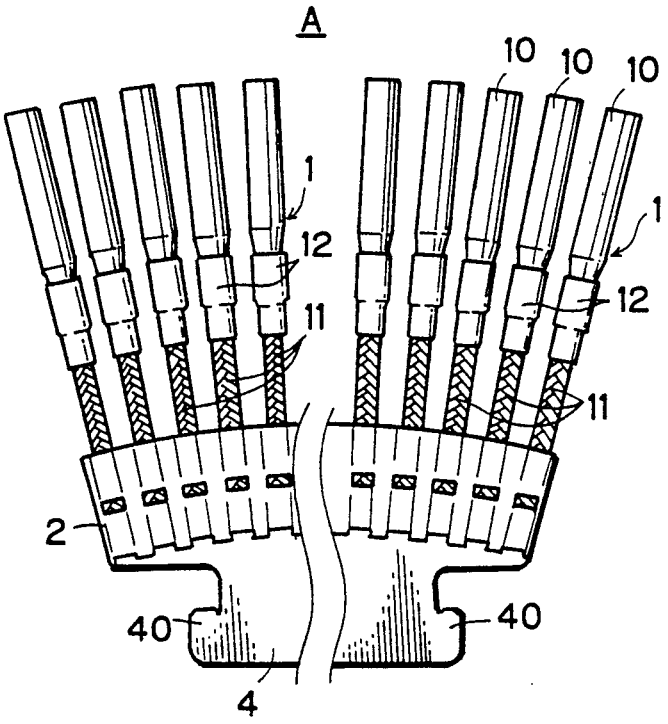
FIG. 3 is a front view partly broken away and showing the brush disk segment of FIG. 1 in greater detail.

Indicated at A is a brush disk segment which includes a wedge-shaped board 2 substantially in the form of a sector with an angle of about 15 to about 60 degrees, preferably about 30 degrees, and a plurality of abrasive members 1 attached to the outer peripheral edge of the board 2. Each of the abrasive members 1 comprises an elastic rod 11 implanted in the board 2, a sleeve 12 secured at its base end to the free end of the rod 11 and an abrasive tip 10 secured at its base end to the sleeve 12 (FIG. 3). A braid of nylon or like synthetic fiber impregnated with resin (FIG. 3) may be used as the rod 11. An abrasive material, such as abrasive grains, shaped into a solid rod using a resin binder may be used as the abrasive tip 10. The abrasive member can be a known bristle comprising as a base material a bundle of synthetic fibers or yarns of synthetic fibers having incorporated therein abrasive grains or like abrasive material.

A plastics molding is used for the board 2. The abrasive members 1 can be attached to the board of plastics molding by inserting the abrasive members 1 into a molding die and molding a plastics material in the die by insert molding. Alternatively, bores are formed in the outer peripheral edge of the board molded of plastics to a considerable depth and tightly implanting the abrasive members 1 in the bores.

The board 2 of the brush disk segment A has a key 4 substantially resembling a dovetail, for example, inverted T-shaped, and opposed to the periphery of a shaft 3.

Figure 6:
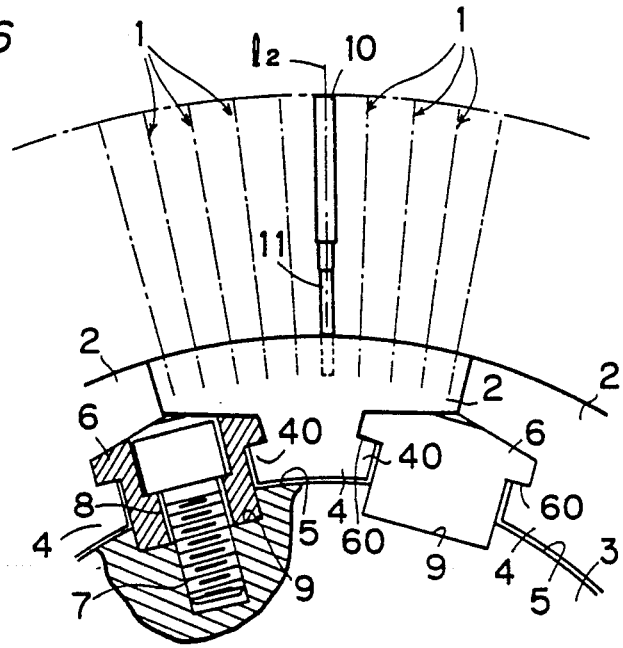
FIG. 6 is a fragmentary elevation showing another embodiment of the invention and schematically showing a brush disk segment.
Figure 7:
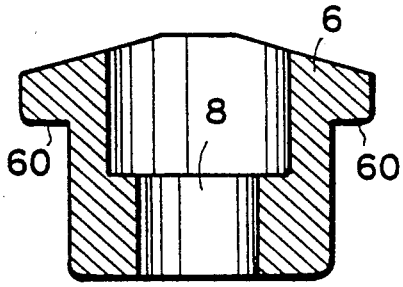
FIG. 7 is a cross sectional view of a bar member included in the embodiment of FIG. 6 for forming a key groove.
Figure 8:
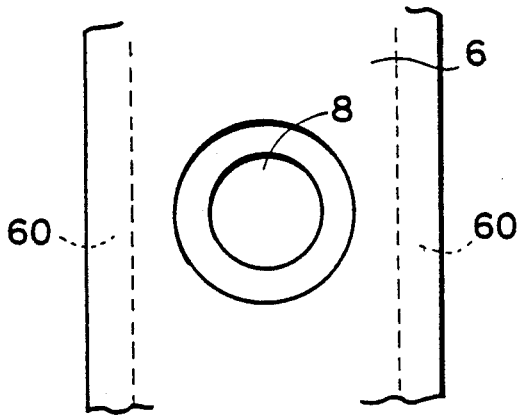
FIG. 8 is a plan view of the bar member.

Key grooves 5 are formed in the peripheral surface of the shaft 3 in specified positions. Each of the key grooves 5 is, for example, inverted T-shaped, substantially resembling a dovetail, and extends longitudinally of the shaft 3 for the key 4 to fit in. The key grooves 5 can be formed directly in the shaft 3 by machining (FIG. 1). The grooved portion 5 shown in FIG. 1 has stepped portions 50, 50 for shoulder portions 40, 40 of the key 4 to engage with respectively. With reference to FIGS. 7 and 8, such key grooves 5 can be formed around the shaft 3 by a plurality of bar members of extending longitudinally of the shaft 3, fixed to the periphery of the shaft 3 and arranged circumferentially thereof at a specified spacing. Each of the bar members 6 has stepped portions 60, 60 engageable with the shoulder portions 40, 40 of the keys 4. FIG. 6 shows the key groove 5 thus defined. With the arrangement shown in FIG. 6, the bar member 6 is fixed to the shaft 3 with setscrews 7. The bar member 6 has some holes 8 for the setscrews 7, and the shaft 3 is formed with grooves 9 for the base portions of the bar members 6 to fit in.

Figure 4:
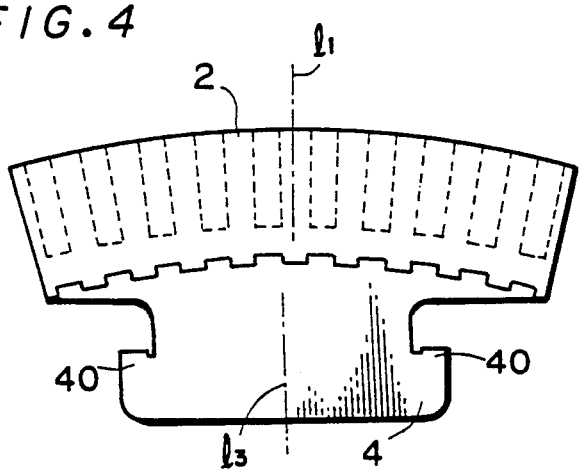
FIG. 4 is a front view of a board included in the brush disk segment of FIG. 1.

Preferably, each board 2 and the arrangement of abrasive members 1 thereon have their respective center lines $l_1$ and $l_3$ aligned with each other, and the board 2 is displaced from the vertical center line $l_3$ of the key 4 toward one direction transverse to the shaft 3, the displacement corresponding to one-half of the pitch of the abrasive members 1 on the board 2 (FIG. 4), so that when the brush disk segments A are mounted in place in the manner to be described below, the abrasive members 1 can be arranged with a sufficient density longitudinally of the shaft.

To mount the brush disk segment A on the shaft 3, the key 4 of the segment A is fitted into the groove 5 in the shaft 3 transversely of the shaft, with the plane of the key 4 in parallel to the axis of the shaft 3, and the segment A is rotated through 90 degrees about the vertical center line $l_3$ of the key 4, whereby the opposite shoulder portions 40, 40 of the key 4 are engaged with the stepped portions 50, 50 or 60, 60 of the key groove 5. Thus, the brush disk segment A is keyed to the groove 5 in the shaft 3 with the key 4 thereof.

Figure 5:
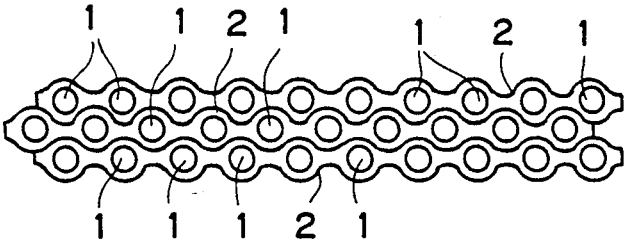
FIG. 5 is a plan view showing such boards as arranged close to one another and also an arrangement of abrasive members.

In the same manner as above, a required number of brush disk segments A are attached to the periphery of the shaft 3 as arranged around the axis of the shaft 3 over an angle of 360 degrees while rotating the shaft 3 about its axis through a suitable angle at a time by suitable means, whereby a circular assembly of disk segments A is formed. The segments A of the assembly face toward one direction (that is, the front surfaces of the segments are oriented in the same direction). The circular assembly of disk segments A over the entire circumference of the shaft is substantially a brush disk. After the segments A have been completely attached to provide the first circular assembly, the required number of brush disk segments A are attached to the periphery of the shaft 3 to form the second circular assembly. The segments for forming the secound circular assembly are oriented in a direction opposite to the direction of the segments A of the first assembly. Brush disk segments A are further attached to the periphery of the shaft 3 to form the third and subsequent circular assemblies. The segments of each of the third and the following circular assemblies are oriented in opposite directional relationship with those of the immediately preceding assembly. In this way, a multiplicity of circular arrangements of brush disk segments A are attached to the shaft 3 as arranged side by side closely longitudinally of the shaft 3. When viewed as an overall arrangement, the abrasive members 1 are arranged zigzag as seen in FIG. 5.

As will be apparent from the above description, the substantial brush disk of the invention is not mounted on the shaft 3 from the end thereof but can be mounted thereon from one side thereof.

The brush disk segment A includes the board 2 having a number of abrasive members 1 attached to its outer peripheral edge. Thus, the segment A is in the form of a board. Accordingly, the disk segments A can be arranged on the shaft 3 closely longitudinally thereof without the necessity of compressing the overall assembly of segments A. When the abrasive member has an outside diameter not larger than the thickness of the board 2, the segments are arranged closely as stated above with the boards 2 in contact with one another. When the outside diameter of the abrasive member 1 is slightly greater than the thickness, a washer as of rubber having a suitable thickness is interposed between the boards 2 arranged longitudinally of the shaft, whereby the same result as above can be achieved. Accordingly, there is no need to use a press for assembling the substantial brush disks longitudinally of the shaft 3 as required. When the disk segments A are to be fastened together, the desired result can be obtained using simple fastening means such as bolts and nuts.

FIGS. 9 to 13 show different modes of fastening the disk segments A longitudinally of the shaft 3. In these drawings, the shaft 3, which is shown only partly at its right end portion, extends toward the left.

Figure 9:
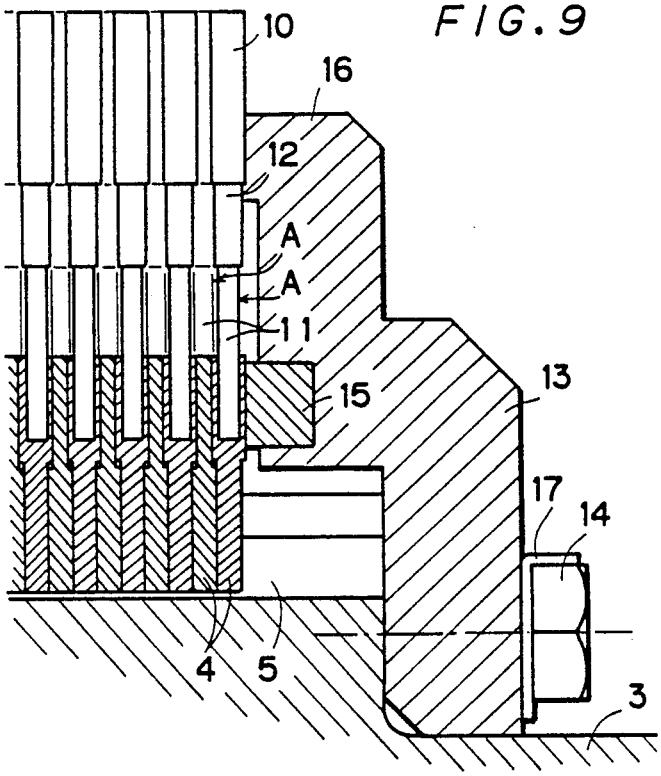
FIG. 9 to 13 are sectional views showing different modes of fastening brush disk segments together longitudinally of a shaft.

In the mode shown in FIG. 9, an annular clamp 13 is fastened to the shaft 3 with a bolt 14, and a ring 15 having rubber elasticity is interposed between the clamp 13 and the outermost disk segments A. The ring 5 is of annular shape and concentric with the clamp 13. Through the ring 15, the claimp 13 fastens the overall assembly of disk segments A longitudinally of the shaft 3. The clamp 13 has a flange 16 in contact with the abrasive tips 10 on the outermost disk segments A. Indicated at 17 in FIG. 9 is a lock washer for the bolt 14.

Figure 10:
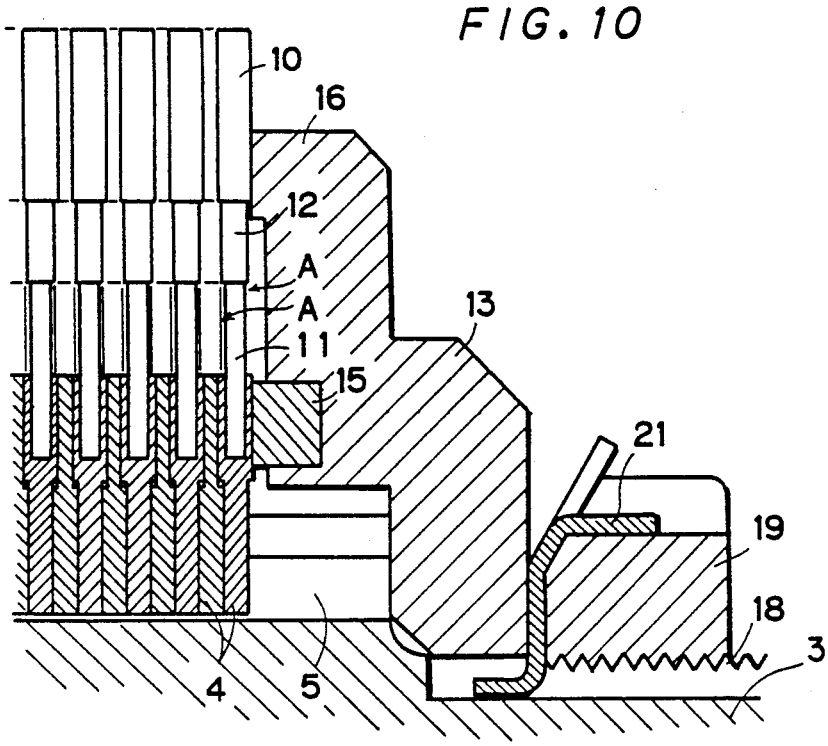

FIG. 10 shows substantially the same mode as FIG. 9 except that a nut 19 is screwed on a threaded portion 18 formed on the shaft 3 to press the clamp 13 against the overall assembly of segments A. Indicated at 21 in FIG. 10 is a lock washer for the nut 19.

Figure 11:
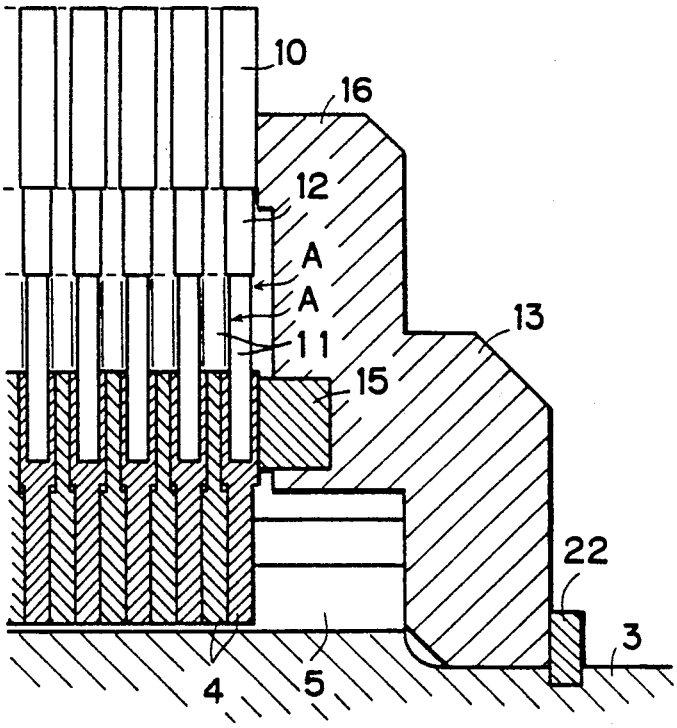

FIG. 11 shows substantially the same mode as FIG. 9 except that a snap ring 22 prevents the clamp 13 from moving toward the right in the drawing relative to the shaft 3.

Figure 12:
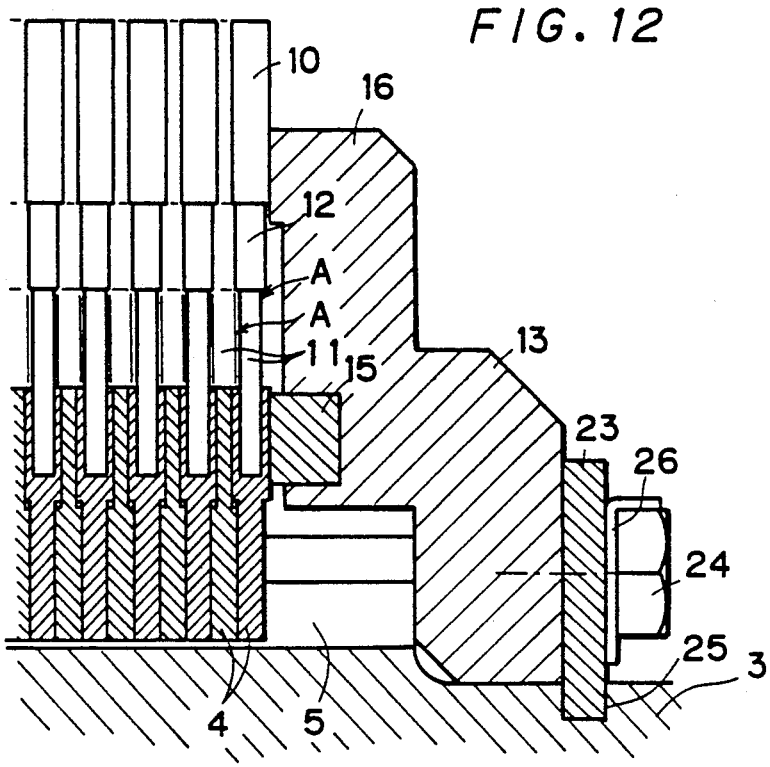

FIG. 12 shows substantially the same mode as FIG. 9 except that a stopper 23 in the form of a half ring is fixed to the clamp 13 with a bolt 24 to cause the stopper 23 to prevent the clamp 13 from moving toward the right in the drawing relative to the shaft 3. The stopper 23 is engaged in a groove 25 formed in the shaft 3. Although FIG. 12 shows only one stopper 23, another stopper also in the form of a half ring is disposed under the illustrated stopper 23 to form a pair therewith. Indicated at 26 is a lock washer for the bolt 24.

Figure 13:
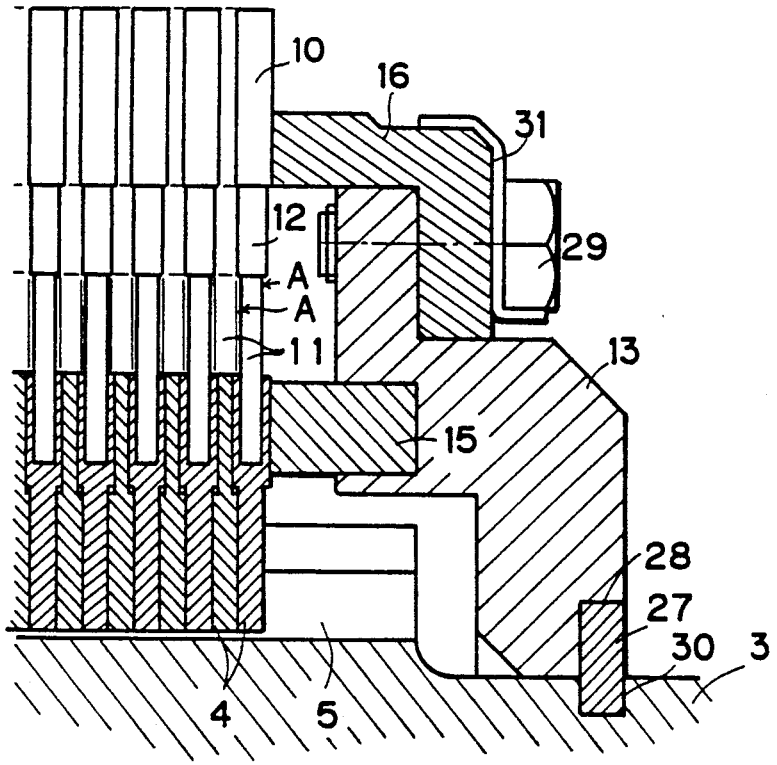

FIG. 13 shows substantially the same mode as FIG. 9 with the exception of the following features. A stopper 27 in the form of a half ring is fitted in a recess 28 formed in the end face of the clamp 13 to cause the stopper 27 to prevent the clamp 13 from moving toward the right in the drawing relative to the shaft 3. The flange 16 is separated from the clamp 13 and is fixed to the clamp 13 with a bolt 29.

The stopper 27 is engaged in a groove 30 formed in the shaft 3. The stopper 27 in FIG. 13 is illustrated and arranged in the same manner as the stopper 23 of FIG. 12. Indicated at 31 is a lock washer for the bolt 29.

In the modes shown in FIGS. 9 to 13, the clamp 13, the fastening member and stopper member therefore, and the ring 15 are illustrated as provided on only one end of the shaft 3, whereas these members are also provided on the other end of the shaft 3.

I claim:

1. A brush roll comprising:

a shaft having an axis and a plurality of substantially dovetail shaped grooves on the surface thereof, said grooves extending longitudinally of the shaft and being spaced circumferentially around the shaft; and a plurality of circular assemblies of brush disk segments mounted on said shaft, said circular assemblies of brush disk segments being spaced longitudinally along said shaft, each circular assembly of brush disk segments comprising a plurality of brush disk segments, each of said brush disk segments comprising a wedge-shaped board which extends about 15° to 60° around said shaft axis, said board having a dovetail shaped key for engaging one of said dovetail shaped grooves on said shaft, and at least one circumferentially extending row of abrasive members attached to said board, each abrasive extending outwardly from said board, each of said dovetail shaped keys being capable of being inserted in a corresponding dovetail shaped groove when said key is parallel to said axis of said shaft and capable of engaging said corresponding dovetail shaped groove when said key is rotated perpendicularly to said axis after being inserted in said groove parallel to said axis, adjacent boards in adjacent grooves having rows of abrasive members extending circumferentially around said axis of said shaft.

2. A brush roll as defined in claim 1, wherein each of said boards has a vertical center line extending radially therethrough, wherein each of said abrasive members on each board in each circular assembly of brush disk segments is arranged on said board at a given angular circumferential pitch, wherein each of said rows on each of said boards of abrasive members has a vertical center line extending radially therethrough which is aligned with said vertical center line of said board, wherein each of said dovetail shaped keys on each of said boards has a vertical center line extending radially therethrough which is circumferentially angularly displaced from said vertical center line of said board by an angle corresponding to one-half of said pitch, and wherein adjacent circular assemblies have rows of abrasive members which face in opposite directions along said axis of said shaft, whereby said circular assemblies of brush disk segments can be closely spaced longitudinally of said shaft to permit the abrasive members to be densely arranged longitudinally of said shaft.

3. A brush roll as defined in claim 1, wherein each of the abrasive members comprises an elastic rod implanted in the board, a sleeve having a base end secured to the free end of the rod and an abrasive tip having a base end which is secured to the sleeve.

4. A brush roll as defined in claim 1, wherein the grooves are formed directly in the shaft.

5. A brush roll as defined in claim 1 wherein a plurality of bar members extending longitudinally of the shaft are fixed to the periphery of the shaft and arranged circumferentially thereof at a specified spacing, each of the bar members having a stepped portion engageable with a shoulder portion of the key, whereby the key grooves are formed around the shaft.

6. A brush roll as defined in claim 1, wherein the circular assemblies arranged longitudinally on the shaft are fastened in place by a clamp provided on the shaft, and an elastic ring is provided between the segments and the clamp.

7. A brush roll as defined in claim 6 wherein the clamp is bolted to the shaft.

8. A brush roll as defined in claim 6 wherein the clamp is fastened to the shaft with a nut screwed on the shaft.

9. A brush roll as defined in claim 6 wherein the clamp is locked to the shaft with a snap ring.

10. A brush roll as defined in claim 6 wherein a stopper in the form of a half ring is fixed to the clamp, and the stopper is engaged in a groove formed in the shaft, whereby the clamp is locked to the shaft.

11. A brush roll as defined in claim 6 wherein a stopper in the form of a half ring is fitted in a recess formed in the outer face of the clamp, and the stopper is engaged in a groove formed in the shaft, whereby the clamp is locked to the shaft.

* * * * *